US006576603B2

(12) United States Patent
Smith et al.

(10) Patent No.: US 6,576,603 B2
(45) Date of Patent: Jun. 10, 2003

(54) PROCESS FOR MAKING LOW VISCOSITY ETHER SULFATES

(75) Inventors: George A. Smith, Austin, TX (US); John F. Hessel, Doylestown, PA (US); Christina M. Haas, Collegeville, PA (US)

(73) Assignee: Cognis Corporation, Cincinnati, OH (US)

( * ) Notice: Subject to any disclaimer, the term of this patent is extended or adjusted under 35 U.S.C. 154(b) by 0 days.

(21) Appl. No.: 09/999,288

(22) Filed: Nov. 15, 2001

(65) Prior Publication Data

US 2002/0119906 A1 Aug. 29, 2002

Related U.S. Application Data

(60) Provisional application No. 60/251,654, filed on Dec. 6, 2000.

(51) Int. Cl.[7] ..... C11D 17/00

(52) U.S. Cl. ..... 510/424; 510/123; 510/126; 510/127; 510/158; 510/218; 510/426; 510/427; 510/470; 510/490; 510/492; 510/536

(58) Field of Search ..... 510/123, 126, 510/127, 158, 159, 218, 403, 404, 426, 427, 470, 490, 497, 424, 492, 536

(56) References Cited

U.S. PATENT DOCUMENTS

| | | | | |
|---|---|---|---|---|
| 5,266,690 A | | 11/1993 | McCurry, Jr. et al. | |
| 5,578,560 A | * | 11/1996 | Giesen et al. | 510/237 |
| 5,851,974 A | * | 12/1998 | Sandhu | 510/235 |
| 6,087,320 A | * | 7/2000 | Urfer et al. | 510/470 |

* cited by examiner

*Primary Examiner*—Necholus Ogden
(74) *Attorney, Agent, or Firm*—John E. Drach; Steven J. Trzaska

(57) ABSTRACT

A surfactant composition containing: (a) from about 30 to about 70% by weight of an alkyl ether sulfate; (b) from about 0.1 to about 10% by weight of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6; and (c) from about 0.1 to about 10% by weight of a salt, all weights being based on the total weight of the composition.

34 Claims, No Drawings

PROCESS FOR MAKING LOW VISCOSITY ETHER SULFATES

CROSS-REFERENCE TO RELATED APPLICATIONS

This application claims the benefit of copending provisional application serial No. 60/251,654 filed on Dec. 6, 2000.

STATEMENT REGARDING FEDERALLY SPONSORED RESEARCH OR DEVELOPMENT

Not applicable.

BACKGROUND OF THE INVENTION

The present invention generally relates to a process for making low viscosity ether sulfates. More particularly, the viscosity of ether sulfates can be lowered by forming nematic liquid crystals in concentrated ether sulfate systems with the use of alkyl polyglycosides.

It is known that various surfactants have been found to be useful in cleaning compositions, such as shower gels, shampoos, and light duty detergents such as dishwashing detergents. In these types of compositions, good foamability is a prerequisite. The most widely used surfactants in these types of compositions are anionic surfactants such as alkyl sulfates, alkyl ether sulfates, sulfonates, sulfosuccinates and sarcosinates.

Mixtures of surfactants are prepared and sold for a wide variety of industrial and domestic applications. They are often required in a fluid form, and it is desirable that they should contain as high a proportion of active material as possible.

Ether sulfates are commonly used in HDL and LDL detergent formulations. These compounds have a tendency to form viscous gels in concentrated solutions. Consequently, hydrotropes such as ethanol and sodium xylene sulfonate are commonly added to the concentrated solution in order to reduce the viscosity of the ether sulfate solutions, thereby preventing subsequent gel phase formation. The high viscosity in concentrated systems containing ether sulfates is believed to be due to the formation of hexagonal and lamellar liquid crystal phases in the system.

While the use of non-surface active hydrotropes to reduce the viscosity of concentrated ether sulfate systems has proven to be fairly effective, it would be much more desirable to avoid the addition of any non-surface active, volatile organic compounds and, instead, employ surface-active, VOC-free compounds to achieve the same viscosity-reducing affect.

BRIEF SUMMARY OF THE INVENTION

The present invention is directed to a concentrated surfactant composition having nematic liquid crystal phases, the composition containing:

(a) from about 30 to about 70% by weight of an alkyl ether sulfate;

(b) from about 0.1 to about 10% by weight of an alkyl polyglycoside corresponding to formula I:

$$R_1O(R_2O)_b(Z)_a \quad \text{(I)}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6;

(c) from about 0.1 to about 10% by weight of a salt; and (d) remainder, water, all weights being based on the total weight of the composition.

The present invention is also directed to a process for reducing the viscosity of an alkyl ether sulfate concentrate which does not require the use of a non-surface active hydrotrope and/or volatile organic compound, involving:

(a) providing from about 30 to about 70% by weight of an alkyl ether sulfate;

(b) providing from about 0.1 to about 10% by weight of an alkyl polyglycoside of formula I:

$$R_1O(R_2O)_b(Z)_a \quad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6; and (c) providing from about 0.1 to about 10% by weight of a salt; and (d) combining (a)–(c) to form a concentrated alkyl ether sulfate composition having nematic liquid crystal phases and a viscosity, at room temperature, of from about 4,000 to about 10,000 cps.

DETAILED DESCRIPTION OF THE INVENTION

Other than in the operating examples, or where otherwise indicated, all numbers expressing quantities of ingredients or reaction conditions used herein are to be understood as being modified in all instances by the term "about".

Alkyl ether sulfates are generally defined as salts of sulfated adducts of ethylene oxide with fatty alcohols containing from about 8 to about 16 carbon atoms. The alkyl ether sulfates employed in the present invention are commercially available and contain a linear aliphatic group having from about 8 to about 16 carbon atoms, and preferably from about 12 to about 16 carbon atoms. The degree of ethoxylation is from 1 to about 10 moles of ethylene oxide, and preferably about 2 to 3 moles of ethylene oxide. A particularly preferred alkyl ether sulfate for use in the present invention is $C_{12-16}$ ether sulfate having 2 moles of ethylene oxide, commercially available under the tradename TEXAPON® NC-70.

The alkyl polyglycosides which can be used in the present invention are those corresponding to formula I:

$$R_1O(R_2O)_b(Z)_a \quad \text{(I)}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa., 19002. Examples of such surfactants include but are not limited to:

1. GLUCOPON® 220 UP Surfactant—an alkyl polyglycoside in which the alkyl group contains 8 to 10 carbon atoms and having an average degree of polymerization of 1.5.
2. GLUCOPON® 425 Surfactant—an alkyl polyglycoside in which the alkyl group contains 8 to 16 carbon atoms and having an average degree of polymerization of 1.6.
3. GLUCOPON® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.6.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl group contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The preferred alkyl polyglycosides are those of formula I wherein $R_1$ is a monovalent organic radical having from about 8 to about 10 carbon atoms; b is zero; Z is a glucose residue having 5 or 6 carbon atoms; a is a number having a value from 1 to about 3, and most preferably about 1.6.

The salts which may be employed in the present invention are those compounds formed when the hydrogen of an acid is replaced by a metal or its equivalent. Examples of suitable salts include, but are not limited to, sodium, ammonium and potassium chloride.

According to one embodiment of the present invention, there is provided a concentrated alkyl ether sulfate composition having nematic liquid crystal phases present therein and a viscosity, at room temperature, of from about 4,000 to about 20,000 cps, and preferably from about 4,000 to about 10,000 cps. The concentrated alkyl ether sulfate composition of the present invention contains: (a) from about 30 to about 70% by weight, and preferably from about 50 to about 70% by weight, of an alkyl ether sulfate, (b) from about 0.1 to about 10% by weight, and preferably from about 1 to about 7% by weight, and most preferably from about 2.5 to about 6% by weight, of an alkyl polyglycoside corresponding to formula I, and preferably one wherein $R_1$ is a monovalent organic radical having from about 8 to about 10 carbon atoms, b is zero, and a is a number having a value of from about 1 to about 3, and preferably about 1.6, and (c) from about 0.1 to about 10% by weight, and preferably from about 1 to about 7% by weight, and most preferably from about 2.5 to about 6% by weight, of a salt, preferably sodium chloride, all weights being based on the total concentration of actives in the composition.

In a particularly preferred embodiment of the present invention, the alkyl ether sulfate concentrate is based on a $C_{12-16}$ ether sulfate ethoxylated with 2 moles of ethylene oxide, and is characterized by the fact that it is free of both volatile organic compounds and non-surface active hydrotropes.

According to another embodiment of the present invention, there is provided a process for reducing the viscosity of an alkyl ether sulfate concentrate which does not require the use of a non-surface active hydrotrope and/or volatile organic compound. The resultant alkyl ether sulfate concentrate has a viscosity, at room temperature ranging from about 4,000 to about 20,000 cps, and preferably from about 4,000 to about 10,000 cps. The process involves: (a) providing a concentrated alkyl ether sulfate composition containing from about 30 to about 70% by weight, and preferably from about 50 to about 70% by weight, and most preferably from about 55 to about 65% by weight, alkyl ether sulfate, (b) providing from about 0.1 to about 10% by weight, and preferably from about 1 to about 7% by weight, and most preferably from about 2.5 to about 6% by weight, of an alkyl polyglycoside corresponding to formula 1, and preferably one wherein $R_1$ is a monovalent organic radical having from about 8 to about 10 carbon atoms, b is zero, and a is a number having a value of from about 1 to about 3, and preferably about 1.6, and (c) providing from about 0.1 to about 10% by weight, and preferably from about 1 to about 7% by weight, and most preferably from about 2.5 to about 6% by weight, of a salt, preferably sodium chloride, all weights being based on the total concentration of actives in the composition.

In a particularly preferred embodiment of the present invention, the alkyl ether sulfate concentrate is based on a $C_{12-16}$ ether sulfate ethoxylated with 2 moles of ethylene oxide. Moreover, the process is characterized by the fact that neither volatile organic compounds nor non-surface active hydrotropes are employed to achieve the above-noted viscosity of the alkyl ether sulfate concentrate.

Without intending to be bound by any scientific theory, it is believed that it is the presence of hexagonal and lamellar liquid crystals in the above-disclosed alkyl ether sulfate concentrate that render it a solid, at room temperature, thereby making it unpourable in the absence of any rheology modifiers.

The viscosity of a commercially available alkyl ether sulfate concentrate is typically in excess of 1,000,000 cps. By adding the above-described alkyl polyglycoside and salt to the concentrated alkyl ether sulfate, it is believed that the hexagonal and lamellar liquid crystal phases of the concentrate are transformed into nematic liquid crystal phases. It is the formation of these nematic liquid crystal phases that causes the viscosity of the resultant concentrated alkyl ether sulfate composition to be drastically lowered from in excess of 1,000,000 to from about 4,000 to about 20,000 cps, and preferably from about 4,000 to about 10,000 cps, thereby rendering the concentrate more pourable at room temperature, in the absence of any hydrotropes.

The alkyl polyglycoside and salt components can be added to the alkyl ether sulfate concentrate using any conventional means such as, for example, stirring at a temperature of from about 20 to about 70° C., and preferably about 40° C. Once the addition is complete, the resultant concentrated alkyl ether sulfate composition will have a final viscosity, at room temperature, of from about 4,000 to about 20,000 cps, and preferably from about 4,000 to about 10,000 cps.

The concentrated alkyl ether sulfate composition can then later be diluted for use in a variety of applications such as, for example, in heavy duty liquid and light duty liquid detergents.

The present invention will be better understood from the examples which follow, all of which are intended to be illustrative only and not meant to unduly limit the scope of the invention. Unless otherwise indicated, percentages are on a weight-by-weight basis.

EXAMPLES

In order to identify regions of low viscosity where nematic liquid crystals are present, various alkyl ether sulfate concentrates were prepared by mixing the individual ingredients together and heating them to 70° C. The samples were then allowed to cool to ambient temperature and their viscosity was measured with a Brookfield viscometer. Their precise formulation and viscosity data are found in Table 1, below.

TABLE 1

| SAMPLE | TEXAPON NC-70 | GLUCOPON 220UP | NaCl | VISCOSITY (cps) |
|---|---|---|---|---|
| 1 | 50% | 5% | 5% | 7000 |
| 2 | 50% | 0 | 0 | >1,000,000 |
| 3 | 50% | 5% | 2.5% | 7600 |

As can be seen from the data in Table 1, those samples containing both an alkyl polyglycoside and a salt significantly reduced the viscosity of the alkyl ether sulfate concentrate.

What is claimed is:

1. A surfactant composition comprising:

(a) from about 30 to about 70% by weight of an alkyl ether sulfate;

(b) from about 0.1 to about 10% by weight of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6; and (c) from about 0.1 to about 10% by weight of a salt, all weights being based on the total weight of the composition and wherein the composition has a viscosity, at room temperature, of from about 4,000 to about 20,000 cps.

2. The composition of claim 1 wherein the alkyl ether sulfate is present in the composition in an amount of from about 50 to about 70% by weight, based on the total weight of the composition.

3. The composition of claim 1 wherein the alkyl ether sulfate is a $C_{12-16}$ ether sulfate containing 2 moles of ethylene oxide.

4. The composition of claim 1 wherein in formula I $R_1$ is a monovalent organic radical having from about 8 to about 10 carbon atoms, b is zero, and a is a number having a value of about 1.5.

5. The composition of claim 1 wherein the alkyl polyglycoside is present in the composition in an amount of from about 2.5 to about 6.0% by weight, based on the total weight of the concentrate.

6. The composition of claim 1 wherein the salt is sodium chloride.

7. The composition of claim 1 wherein the salt is present in the composition in an amount of from about 2.5 to about 6% by weight, based on the total concentration of actives in the composition.

8. The composition of claim 1 wherein the composition has a viscosity, at room temperature, ranging from about 4,000 to about 10,000 cps.

9. The composition of claim 1 wherein the composition is free of both a non-surface active hydrotrope and a volatile organic compound.

10. A surfactant composition comprising:

(a) from about 50 to about 70% by weight of a $C_{12-16}$ ether sulfate having 2 moles of ethylene oxide;

(b) from about 2.5 to about 6% by weight of an alkyl polyglycoside of formula I:

$$R_1O(R_2O)_b(Z)_a \qquad \text{I}$$

wherein $R_1$ is a monovalent organic radical having from about 8 to about 10 carbon atoms; $R_2$ is a divalent alkylene radical having from 2 to 4 carbon atoms; Z is a saccharide residue having 5 or 6 carbon atoms; b is zero; a is a number having a value of about 1.5;

(c) from about 2.5 to about 6.0% by weight of a sodium salt; and (d) remainder, water, all weights being based on the total weight of the composition, and wherein the composition has a viscosity, at room temperature, ranging from about 4,000 to about 10,000 cps.

11. The composition of claim 10 wherein the composition is free of both non-surface active hydrotropes and volatile organic compounds.

12. A process for reducing the viscosity of an alkyl ether sulfate composition to a range, at room temperature, of from about 4,000 to about 20,000 cps comprising adding to the alkyl ether sulfate composition:

(a) from about 0.1 to about 10% by weight of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a sacchande residue having 5 or 6 carbon atoms; b is a number having a value from 0 to about 12; a is a number having a value from 1 to about 6; and (b) from about 0.1 to about 10% by weight of a salt.

13. The process of claim 12 wherein the alkyl ether sulfate composition has an actives concentration of from about 30 to about 70% by weight, based on the total weight of the concentrate.

14. The process of claim 12 wherein the alkyl ether sulfate is a $C_{12-16}$ ether sulfate having 2 moles of ethylene oxide.

15. The process of claim 12 wherein in formula I $R_1$ is a monovalent organic radical having from about 8 to about 10 carbon atoms, b is zero, and a is a number having a value of about 1.5.

16. The process of claim 12 wherein the alkyl polyglycoside is present in the composition in an amount of from about 2.5 to about 6% by weight, based on the total weight of the concentrate.

17. The process of claim 12 wherein the salt is sodium chloride.

18. The process of claim 12 wherein the salt is present in the composition in an amount of from about 2.5 to about 6% by weight, based on the total weight of the concentrate.

19. The process of claim 12 wherein the composition has a viscosity, at room temperature, of from about 4,000 to about 10,000 cps.

20. The process of claim 12 wherein the composition is free of both non-surface active hydrotropes and volatile organic compounds.

21. A process for reducing the viscosity of a surfactant composition containing from about 50 to about 70% by weight of a $C_{12-16}$ ether sulfate having 2 moles of ethylene oxide, comprising adding to the surfactant composition:

(a) from about 2.5 to about 6% by weight of an alkyl polyglycoside of formula I:

$$R_1O(R_2O)_b(Z)_a \qquad \text{I}$$

wherein $R_1$ is a monovalent organic radical having from about 8 to about 10 carbon atoms; $R_2$ is a divalent alkylene radical having from 2 to 4 carbon atoms; Z is a saccharide residue having 5 or 6 carbon atoms; b is zero; a is a number having a value of about 1.5; and (b) from about 2.5 to about 6% by weight of a sodium salt.

22. The process of claim 21 wherein the composition is free of both non-surface active hydrotropes and volatile organic compounds.

23. The product of the process of claim 12.
24. The product of the process of claim 13.
25. The product of the process of claim 14.
26. The product of the process of claim 15.
27. The product of the process of claim 16.
28. The product of the process of claim 17.
29. The product of the process of claim 18.
30. The product of the process of claim 19.
31. The product of the process of claim 20.
32. The product of the process of claim 21.
33. The product of the process of claim 22.
34. The product of the process of claim 23.

* * * * *